US008882867B2

(12) United States Patent
Kuske et al.

(10) Patent No.: US 8,882,867 B2
(45) Date of Patent: Nov. 11, 2014

(54) GASIFICATION REACTOR WITH DOUBLE WALL COOLING

(75) Inventors: Eberhard Kuske, Soest (DE); Johannes Dostal, Dortmund (DE); Reinald Schulze Eckel, Muenster (DE); Lothar Semrau, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 437 days.

(21) Appl. No.: 13/384,393

(22) PCT Filed: Jul. 16, 2010

(86) PCT No.: PCT/EP2010/004339

§ 371 (c)(1),
(2), (4) Date: Jan. 17, 2012

(87) PCT Pub. No.: WO2011/012231

PCT Pub. Date: Feb. 3, 2011

(65) Prior Publication Data

US 2012/0110906 A1 May 10, 2012

(30) Foreign Application Priority Data

Jul. 28, 2009 (DE) ..... 10 2009 035 052

(51) Int. Cl.

| | |
|---|---|
| ***B01J 7/00*** | (2006.01) |
| ***C10J 3/48*** | (2006.01) |
| ***C10J 3/76*** | (2006.01) |
| ***C10J 3/82*** | (2006.01) |
| ***C10J 3/84*** | (2006.01) |

(52) U.S. Cl.

CPC .. *C10J 3/485* (2013.01); *C10J 3/76* (2013.01); *C10J 3/82* (2013.01); *C10J 3/845* (2013.01); *C10J 2200/09* (2013.01)

USPC ..... 48/61

(58) Field of Classification Search

CPC ..... C10J 3/845; C10J 2200/09; C10J 3/84; C10K 1/101; C10K 1/08; C10K 1/10

See application file for complete search history.

(56) References Cited

U.S. PATENT DOCUMENTS 4,474,584 A 10/1984 Koog
5,782,032 A * 7/1998 Tanaka et al. ..... 48/77

(Continued)

FOREIGN PATENT DOCUMENTS

DE 40 25 955 1/1991
DE 10 2006 031 816 1/2008

(Continued)

OTHER PUBLICATIONS

International Search Report of PCT/EP2010/004339, date of mailing May 23, 2011.

*Primary Examiner* — Imran Akram
(74) *Attorney, Agent, or Firm* — Collard & Roe, P.C.

(57) ABSTRACT

It is supposed to be possible to achieve an essentially uniform water film protecting the corresponding metal panels, in a gasification reactor for producing crude gas containing CO or H2, by gasification of ash-containing fuel with oxygen-containing gas, at temperatures above the melting temperature of the ash, wherein a reaction chamber formed by a membrane wall through which cooling medium flows, a transition area as well as a quench chamber with a slag collection container that follows in the direction of gravity are provided within a pressure container. This is achieved in that, in addition to a device (14, 15) forming a water film (16) in the quench chamber (11), at least a part of the cylinder forming the quench chamber wall (17) is designed with a double wall and with a coolant overflow (21) for additionally wetting (18) the inner surface of the quench chamber wall (17), and a tangential coolant supply (20) in the bottom area of the double walled cylinder (19) which is closed at the bottom.

5 Claims, 3 Drawing Sheets

(56) References Cited

U.S. PATENT DOCUMENTS

Figure 1:
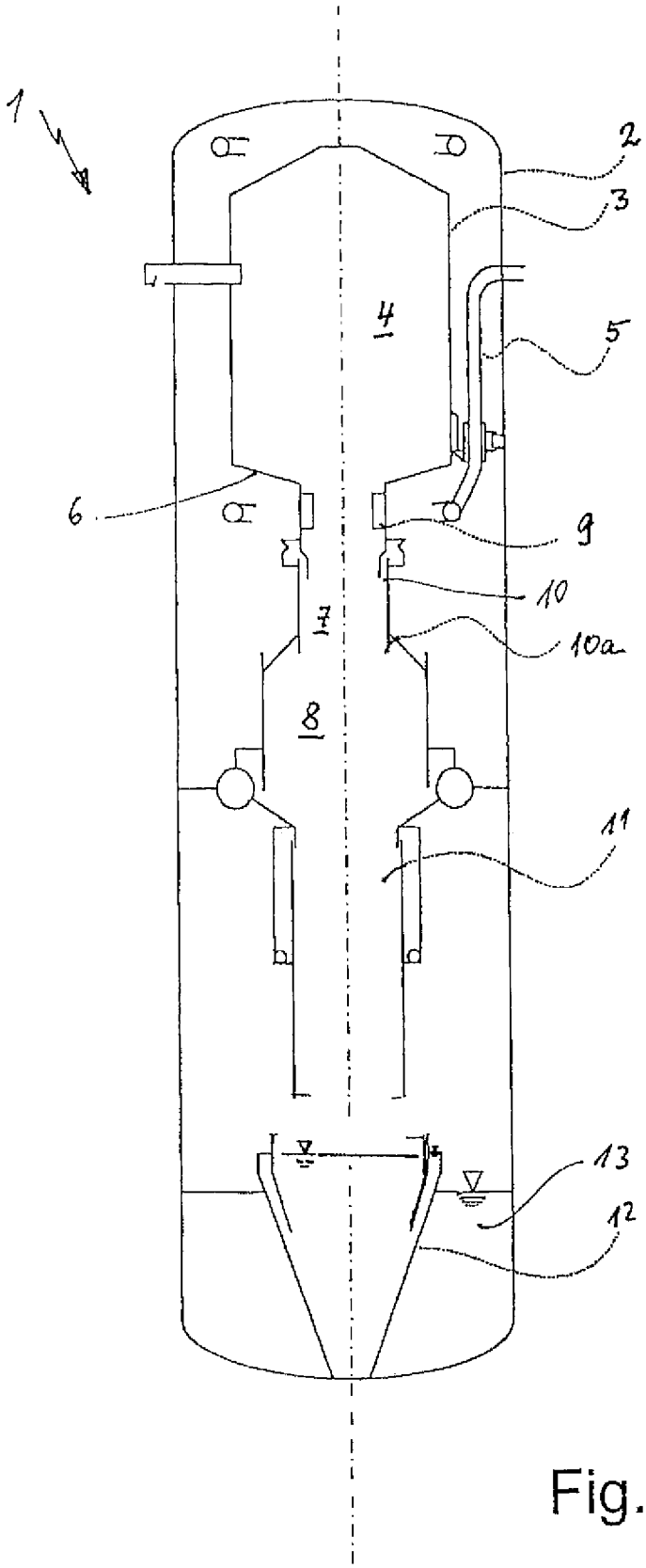

| | | | | |
|---|---|---|---|---|
| 6,283,048 | B1 * | 9/2001 | Fujinami et al. | 110/346 |
| 2008/0005966 | A1 | 1/2008 | Fischer et al. | |
| 2008/0034657 | A1 * | 2/2008 | Van Den Berg et al. | 48/62 R |
| 2008/0041572 | A1 * | 2/2008 | Wessel et al. | 165/157 |
| 2008/0175770 | A1 * | 7/2008 | Wallace | 422/201 |
| 2009/0202403 | A1 * | 8/2009 | Jimenez-Huyke et al. | 422/198 |
| 2010/0263278 | A1 | 10/2010 | Kowoll et al. | |
| 2011/0058991 | A1 * | 3/2011 | Kuske et al. | 422/187 |

FOREIGN PATENT DOCUMENTS

| | | |
|---|---|---|
| JP | 2004 256657 | 9/2004 |
| WO | WO 2009/036985 | 3/2009 |

* cited by examiner

GASIFICATION REACTOR WITH DOUBLE WALL COOLING

CROSS REFERENCE TO RELATED APPLICATIONS

This application is the National Stage of PCT/EP2010/004339 filed on Jul. 16, 2010, which claims priority under 35 U.S.C. §119 of German Application No. 10 2009 035 052.7 filed on Jul. 28, 2009, the disclosure of which is incorporated by references. The international application under PCT article 21(2) was not published in English.

The invention relates to a gasification reactor for producing crude gas containing CO or $H_2$.

Such a gasification reactor is known, for example, from WO 2009/036985 A1 by the applicant, whereby a wealth of prior art is cited in this document, such as U.S. Pat. No. 4,474,584, for example, that in particular addresses the cooling of hot synthesis gas.

In particular, the invention concerns itself with problems that occur in such reactors, whereby the invention is not restricted to the gasification reactor that is specifically addressed here; it is also directed at apparatuses in which problems described in greater detail below can occur.

Such an apparatus must be suitable to enable methods of pressure gasification/combustion of finely distributed fuels, which includes the partial oxidation of the fuels coal dust, finely distributed biomass, oil, tars, or the like in a reactor. This also includes the separate or joint withdrawal of slag or fly ash, and generated synthesis gas or flue gas. Cooling of the reaction products (gas and slag/fly ash) must be enabled, for example by spray quenching, gas quenching, radiation quenching, convective heating surfaces, or the like, depending on the type of method used, whereby finally, attention also has to be directed towards discharge of the reaction products from the pressure container.

A problem that arises with such reactors is the cooling of the surfaces forming the quench chamber, as well as the protection of the reactor wall against overheating.

In WO 2009/036985 A1, a waterfall is formed following the reaction chamber or in the transitional area, which is intended to protect the wall surrounding the quench chamber from overheating, among other things. DE 10 2006 031 816 B shows somewhat different type of wall cooling. Here, a flow is formed in the annular space between the pressure container wall and the wall forming the quench chamber, which flow, at the top end, flows around the wall forming the quench chamber and flows downward along the wall to protect it. Since interruptions in the built-up water film can always arise at a few places, hot particles or gases can cause damage to the metal panels, in each instance.

The task of the invention is therefore to create a solution by means of which an essentially uniform water film protecting the corresponding metal panels can be achieved.

Given a gasifier of the initially cited type, this task is accomplished, according to the invention, in that, in addition to a device forming a water film in the quench chamber, at least a part of the cylinder forming the quench chamber wall is designed double-walled, with a coolant overflow to additionally wet the inner surface of the quench chamber wall, and a tangential coolant supply in the bottom area of the double-wall cylinder, which is closed at the bottom.

Optimum wetting of the metal panels forming the quench chamber is identifiably achieved by means of the double-wall cooling, among other things, as well as by the generation of a swirl in the cooling flow, with a specific predetermined flow direction in the coolant overflow area.

Embodiments of the invention are evident from the dependent claims. In this connection, the annular overflow chamber can cover approximately one-half the axial length of the quench chamber cylinder, with a coolant overflow disposed at the top, and/or the annular overflow chamber can cover approximately one-fourth of the axial length of the quench chamber cylinder, with the coolant overflow disposed at the top, whereby the size of the double-wall cylinder to which coolant is applied depends on the purpose of use, in each instance.

In another embodiment, it is provided, according to the invention, that nozzles for spraying coolant medium, for additional cooling, are provided in the wall of the cylinder surrounding the quench chamber and/or the wall of the overflow chamber facing outward towards the quench chamber, and/or in the annular space between the pressure container wall and the quench chamber. These measures also serve to provide additional security against the interruption of cooling film, or the like, whereby the injection of coolant is known per se, in part, from the aforementioned type-defining WO 2009/036985.

Figure 2:
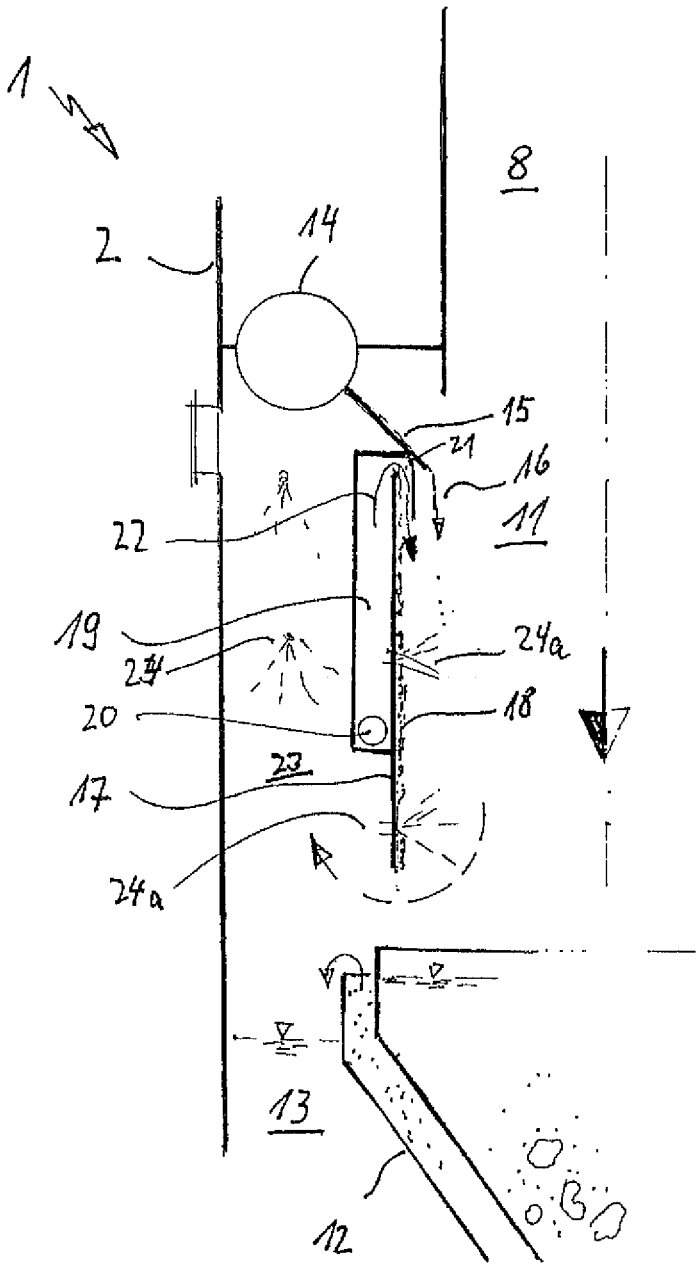
Figure 3:
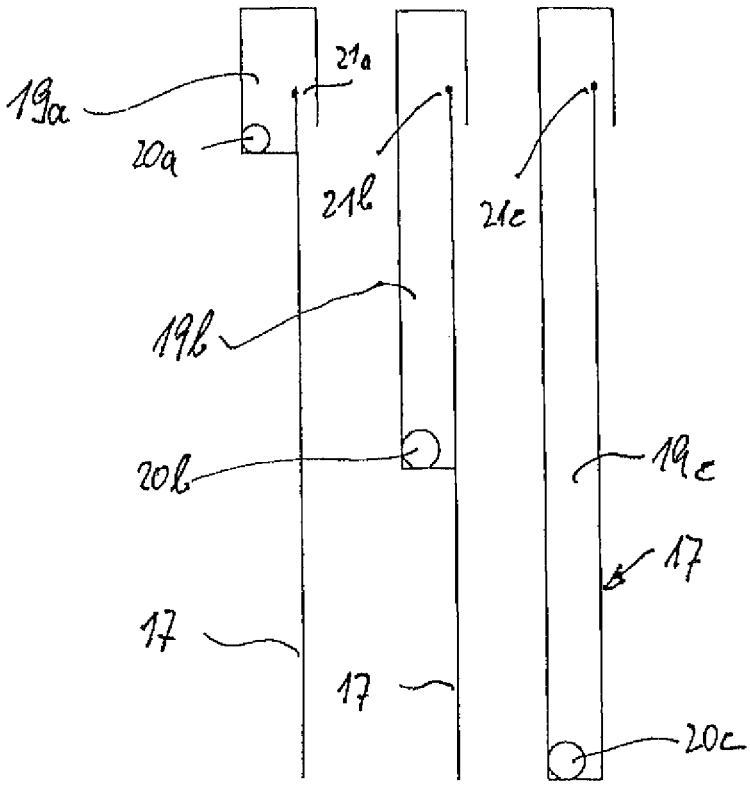

Further details, features and advantages of the invention are evident from the following description and the drawing. This shows, in:

FIG. 1 a schematic drawing of a section of a gasification reactor according to the invention, FIG. 2 an enlarged representation of the wall surfaces to be cooled, in the region of the quench chamber, and FIG. 3 three simplified schematic representations of the double-wall design of the quench chamber.

The gasification reactor shown in FIG. 1 generally identified as 1, has a pressure container 2, in which a reaction chamber 4 enclosed by a membrane wall 3 is disposed at a distance from the pressure container 2, from top to bottom. The coolant feedline to supply the membrane wall 3 is identified as 5. In this connection, the membrane wall 3 transitions, via a bottom cone 6, into a narrowed channel, as part of a transitional area identified as 8, whereby spin brakes 9 are indicated in the narrowed transition channel 7. 10*a* identifies a drip edge at the transition area 8 for the liquid ash, in the transition area, at a distance from the first drip edge 10, at the end of the transition channel 7.

Following the transition area 8 is a quench chamber or quench channel 11, followed by a slag collection container 12 in a water bath 13.

FIG. 2 shows a schematic half-side of a part of the transition area 8 and of the quench chamber 11, on an enlarged scale. By way of a ring distributor 14 and a corresponding supply device 15, a stream of water is supplied to the quench chamber 11, to form a liquid curtain 16.

The cylindrical wall identified as 17, which encloses the quench chamber 11, is partially designed as a double wall, as shown in FIG. 2, to form a double-wall cylinder 19, in which a flow of cooling liquid is introduced by way of a ring injection system 20, in such a manner that a water film identified as 18 also forms on the side of the cylindrical wall 17 facing the quench inner chamber. This cooling liquid also flows with a swirl over the top edge, identified as 21, of the quench chamber wall 17, for example in order to prevent sedimentation of solid particles. This overflow is identified with an arrow 22.

The annular space 23 formed between the pressure container wall 2 and the cylinder 17 enclosing the quench chamber 11 can be equipped with cooling water injection nozzles 24 as indicated in FIG. 2. The edge areas of the cylinder 17 enclosing the quench chamber can also have injection nozzles that are numbered 24*a* in FIG. 2.

FIG. 3 shows three examples of the embodiment of the double cylinder wall 19. In the left figure, this cylinder is comparatively small at the end of the cylinder wall 17, and is identified as 19*a*. Its cooling water supply is given reference number 20*a*.

In the middle illustration, the double-wall cylindrical chamber 19*b* is approximately one-half as large as the entire wall 17, enclosing the quench chamber 11, whereas in the right illustration, the entire wall 17 enclosing the quench chamber is designed as a double-walled cylinder 19*c* that is closed at the bottom.

Of course, the exemplary embodiments of the invention that are described can be altered in many ways, without departing from the basic idea. For example, the cylindrical annular space 19 can be formed from a plurality of annular discs, the injection nozzles for cooling liquid can be distributed symmetrically or asymmetrically on the surface of the cylinder wall 17, and more of the like.

The invention claimed is:

1. A gasification reactor for producing crude gas containing CO or $H_2$ by gasification of ash-containing fuel with oxygen-containing gas, at temperatures above the melting temperature of the ash, said gasification reactor comprising:

(a) a pressure container;

(b) a membrane wall forming a reaction chamber and disposed within the pressure container, wherein cooling medium flows through the membrane wall;

(c) a transition area beneath the reaction chamber and disposed within the pressure container;

(d) a quench chamber beneath the transition area, disposed within the pressure container, and comprising a quench chamber wall, a water-film forming device, and a double-walled cylinder, wherein said double-walled cylinder forms at least a part of the quench chamber wall, has a coolant overflow for additionally wetting an inner surface of the quench chamber wall, has a closed bottom, has a bottom area, has a tangential coolant supply in the bottom area, and forms an annular overflow chamber;

(e) nozzles disposed in the quench chamber wall to spray coolant medium; and (f) a slag collection container beneath the quench chamber and disposed within the pressure container;

wherein the walls of the double-walled cylinder are separate from an exterior wall of the pressure container; and wherein said annular overflow chamber covers at least one-fourth of an axial length of the quench chamber wall.

2. The gasification reactor according to claim 1, wherein the coolant overflow is disposed at a top portion of the annular overflow chamber.

3. The gasification reactor according to claim 1, wherein the annular overflow chamber covers one-half of the axial length of the quench chamber wall, and wherein the coolant overflow is disposed at a top portion of the annular overflow chamber.

4. The gasification reactor according to claim 1, wherein the nozzles are disposed in the walls of the double-walled cylinder and face outward toward the quench chamber.

5. The gasification reactor according to claim 1, further comprising additional nozzles disposed in an annular space between the exterior wall of the pressure container and the quench chamber wall.

* * * * *